US006646524B1

(12) United States Patent
Okada et al.

(10) Patent No.: US 6,646,524 B1
(45) Date of Patent: Nov. 11, 2003

(54) DIELECTRIC FILTER, DIELECTRIC DUPLEXER, AND COMMUNICATION APPARATUS

(75) Inventors: Takahiro Okada, Ishikawa-ken (JP); Jinsei Ishihara, Kanazawa (JP); Hideyuki Kato, Ishikawa-ken (JP)

(73) Assignee: Murata Manufacturing Co. Ltd (JP)

( * ) Notice: Subject to any disclaimer, the term of this patent is extended or adjusted under 35 U.S.C. 154(b) by 0 days.

(21) Appl. No.: 09/507,976

(22) Filed: Feb. 22, 2000

(30) Foreign Application Priority Data

Feb. 22, 1999 (JP) ..... 11-043362

(51) Int. Cl.[7] ..... H01P 1/205; H01P 1/213
(52) U.S. Cl. ..... 333/206; 333/134
(58) Field of Search ..... 333/202, 206, 333/134

(56) References Cited

U.S. PATENT DOCUMENTS 5,612,654 A * 3/1997 Tsujiguchi et al. ..... 333/202
5,945,896 A * 8/1999 Miyamoto ..... 333/206

FOREIGN PATENT DOCUMENTS

| | | | |
|---|---|---|---|
| EP | 0664572 A | 7/1995 | ..... 333/202 |
| EP | 0853349 A | 7/1998 | ..... 333/206 |
| EP | 0863566 A | 9/1998 | |
| JP | 7-162212 | 6/1995 | |

* cited by examiner

*Primary Examiner*—Seungsook Ham

(57) ABSTRACT

A stepped portion is formed inside the inner-conductor holes arranged between both side surfaces of a dielectric block. The axis at an open end of the holes is made to be different from the axis at a short-circuited surface. The open ends of the inner-conductor holes are formed so as to be close to corresponding input-output electrodes.

5 Claims, 4 Drawing Sheets

DIELECTRIC FILTER, DIELECTRIC DUPLEXER, AND COMMUNICATION APPARATUS

BACKGROUND OF THE INVENTION

1. Field of the Invention

The present invention relates to a dielectric filter and dielectric duplexer which have a plurality of inner-conductors inside a dielectric block, an external conductor disposed on the outer surface of the dielectric block and input-output electrodes disposed on the outer surface of the dielectric block and capacitance-coupled to inner-conductors, and to a communication apparatus including the same.

2. Description of the Related Art

A dielectric filter having, for example, the construction shown in FIG. 7 has been disclosed (Japanese Utility Model Application No. 6-2802). FIG. 7 is a sectional view passing through two input-output electrodes. In this dielectric filter, three inner-conductor holes 2*a,* 2*b,* and 2*c* passing through between a pair of opposing end surfaces of a dielectric block 1 in the form of a nearly rectangular solid are provided, and inner-conductors 3*a,* 3*b,* and 3*c* are formed on respective internal surfaces thereof. At fixed locations on the external surface of the dielectric block 1 a pair of input-output electrodes 5*a* and 5*b* are formed, and on nearly the whole of the external surface, except the areas where the input-output electrodes 5*a* and 5*b* are formed, an external electrode 4 is formed. This dielectric filter is externally coupled via external coupling capacitances C1 and C2 generated between the input-output electrodes 5*a* and 5*b* and the inner-conductors 3*a* and 3*c,* respectively, which oppose the electrodes. Each of the inner-conductor holes 2*a,* 2*b,* and 2*c* is formed as a straight hole of the same axis having a constant inner diameter, and, of the three inner-conductor holes 2*a,* 2*b,* and 2*c,* the inner-conductor holes 2*a* and 2*c* acting as an input-output stage are arranged close to the sides where the input-output electrodes 5*a* and 5*b* are formed.

In this way, without allowing the $Q_0$ valve of a resonator to fall by arranging an inner-conductor hole opposed to an input-output electrode to be close to the input-output electrode, a large external coupling capacitance can be obtained through an input-output electrode with a relatively small area.

However, in the above conventional dielectric filter, as the whole inner-conductor holes acting as input-output stages are arranged close to the side surfaces where the input-output electrodes are formed, there is a problem of the $Q_0$ valve of the resonator being degraded. This is because the best $Q_0$ valve of the resonator is obtained when the inner-conductor hole is arranged in the middle of the dielectric block and the $Q_0$ valve deteriorates further when the hole is set further from the middle.

SUMMARY OF THE INVENTION

To overcome the above described problems, preferred embodiments of the present invention provide a dielectric filter and dielectric duplexer having a large external coupling capacitance and a higher $Q_0$ valve, and to provide a communication apparatus including the same.

One preferred embodiment of the present invention provides a dielectric filter comprising: a dielectric block;

a plurality of inner-conductor holes each having an inner-conductor disposed on an inner surface thereof provided in the dielectric block; an external conductor disposed on an outer surface of the dielectric block; and an input-output electrode disposed on the outer surface of the dielectric block and capacitance-coupled to the inner-conductors; wherein each of the inner-conductors has an open end in at least one opening surface of the inner-conductor hole or in the vicinity of the opening surface; the inner-conductor hole being opposed to the input-output electrodes has a stepped portion to define a first inner-conductor hole portion and a second inner-conductor hole portion divided thereby; and the first inner-conductor hole portion has the open end and located closer to the input-output electrode than the second inner-conductor hole portion.

In the above described dielectric filter, the sectional area of the first inner-conductor hole portion may be larger than that of the second inner-conductor hole portion.

Another preferred embodiment of the present invention provides a dielectric duplexer comprising at least two filter portions formed in a dielectric block, wherein at least one of the filter portions is composed of the above described dielectric filter.

Yet another preferred embodiment of the present invention provides a communication apparatus comprising at least one of the above described dielectric filters and the dielectric duplexer.

In a dielectric filter or dielectric duplexer having the above construction, as the open end of the inner-conductor hole opposed to an input-output electrode (first inner-conductor hole portion) is arranged so as to be near the input-output electrode, that is, as only part of the inner-conductor hole is made to be eccentric so as to be close to the input-output electrode, a large external coupling capacitance can be obtained, and the $Q_0$ valve is less reduced. That is, when compared with conventional examples where the whole inner-conductor hole is made near an input-output-electrode, the $Q_0$ valve of the resonator can be less reduced.

Furthermore, when the first inner-conductor hole portion is formed so as to have a larger diameter than the other portion (second inner-conductor hole portion), the external coupling capacitance can be further increased.

Therefore, a dielectric filter and dielectric duplexer having a small insertion loss and suitable characteristics can be obtained.

Further, a communication apparatus according to the present invention is composed of a dielectric filter or dielectric duplexer having the above features and accordingly exhibits suitable characteristics.

Other features and advantages of the present invention will become apparent from the following description of the invention which refers to the accompanying drawings.

DESCRIPTION OF THE PREFERRED EMBODIMENTS

Figure 1:
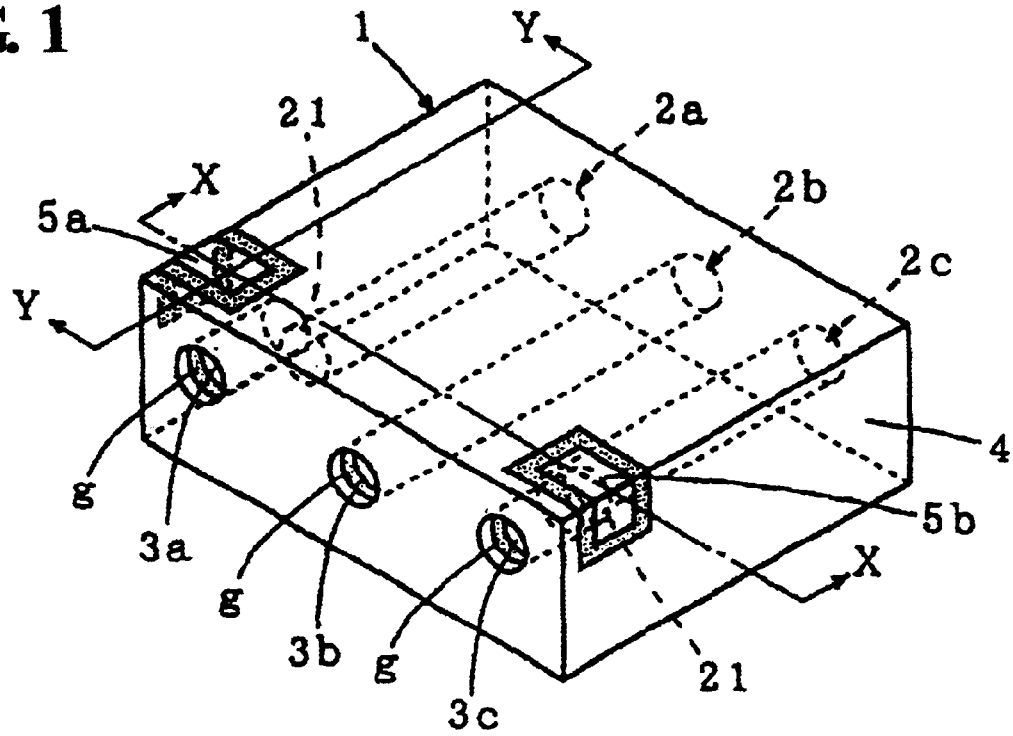
FIG. 1 is a perspective schematic illustration of a dielectric filter of a first embodiment.
Figure 2:
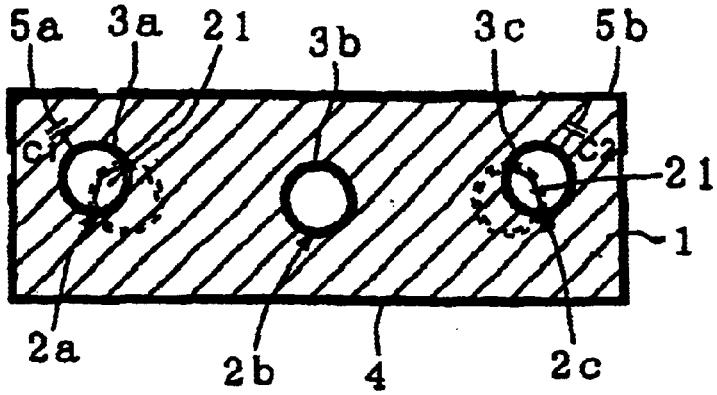
FIG. 2 is a sectional view taken along line X—X of FIG. 1.
Figure 3:
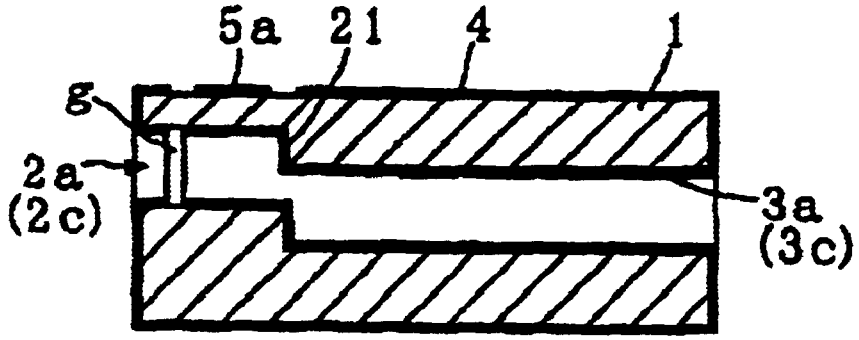
FIG. 3 is a sectional view taken on line Y—Y of FIG. 1.

The construction of a dielectric filter according to a first embodiment of the present invention is explained with reference to FIGS. 1 through 3. FIG. 1 is a perspective illustration of the dielectric filter, FIG. 2 a sectional view taken along line X—X of FIG. 1, and FIG. 3 a sectional view taken along line Y—Y of FIG. 1. More, in the following perspective illustrations, the dotted shaded areas show the ground of dielectric blocks.

The dielectric filter of the present embodiment is composed of a dielectric block 1 in the form of a nearly rectangular solid (hexahedron). Three inner-conductor holes 2*a,* 2*b,* and 2*c* passing through the dielectric block 1 between a pair of opposing end surfaces are formed, and inner-conductors 3*a,* 3*b,* and 3*c,* respectively, are formed on the inside surfaces of the holes. At fixed locations of the outer surface of the dielectric block 1 a pair of input-output electrodes 5*a* and 5*b* are formed, and on nearly the whole of the outer surface, except the areas where the input-output electrodes 5*a* and 5*b* are formed, an external conductor 4 is formed. In the vicinity of one opening surface of the inner-conductor holes 2*a* through 2*c* a portion having no inner-conductor (nonconductive portion) "g" is given, and this portion is made an open end of resonators composed of the inner-conductors 3*a* through 3*c*. That is, at one end surface (end surface at the front side of FIG. 1) each of the inner-conductors 3*a* through 3*c* is separated from the external conductor 4 by the nonconductive portion "g", and at the other end surface (end surface on the other side of FIG. 1) each of the inner-conductors is connected (short-circuited) to the external conductor 4, and this end surface is made a short-circuited surface.

Each of the input-output electrodes 5*a* and 5*b* is formed over one main surface close to the open end and the neighboring side surface of the dielectric block 1. This dielectric filter is externally coupled through external coupling capacitances C1 and C2 generated between the input-output electrodes 5*a* and 5*b* and the respective inner-conductors 3*a* and 3*c* opposed to the electrodes. Further, the dielectric filter is mounted on a mounting board so that the surface where the input-output electrodes 5*a* and 5*b* are formed (upper surface of FIG. 1) becomes a mounting surface.

Inside the inner-conductor holes 2*a* and 2*c* arranged at both side surfaces of the dielectric block a stepped portion 21 is formed to define a first inner-conductor hole portion and a second inner-hole portion divided thereby. The first inner-conductor hole portion has the open end and the second inner-hole portion extends to the short-circuited surface. The axis of the first inner-conductor hole portion is located at a different portion from that of the second inner-hole portion. Moreover, the inner diameters of the first inner-conductor hole portion and the second inner-hole portion are formed to be the same.

The first inner-hole portion of the inner-conductor hole 2*a* is provided to be close to the input-output electrode 5*a,* and the first inner-hole portion of the inner-conductor hole 2*c* is provided near the input-output electrode 5*b*. The second inner-hole portion of the inner-conductor holes 2*a* and 2*c* and the inner-conductor hole 2*b* are arranged in the middle of the dielectric block 1 in the thickness direction.

Thus, because in the dielectric filter of the present embodiment the input-output electrodes 5*a* and 5*b* are constructed to be closer to the inner-conductors 3*a* and 3*c,* respectively, which act as input-output stages and which are opposed to the electrodes, large external coupling capacitances C1 and C2 can be realized. Furthermore, as only the first inner-hole portion of the inner-conductor holes 2*a* and 2*c* are made eccentric so as to be close to the input-output electrodes 5*a* and 5*b,* respectively, the $Q_0$ valve is less reduced.

It is desirable that the above stepped portion 21 be set at a location in which the desired external coupling capacitance can be obtained and be set as close as possible to the end surface at the open end so that the $Q_0$ valve is less reduced. Further, the input-output electrodes are also generally provided to be as close as possible to the end surface at the open end so that the external coupling capacitance is increased.

Figure 4:
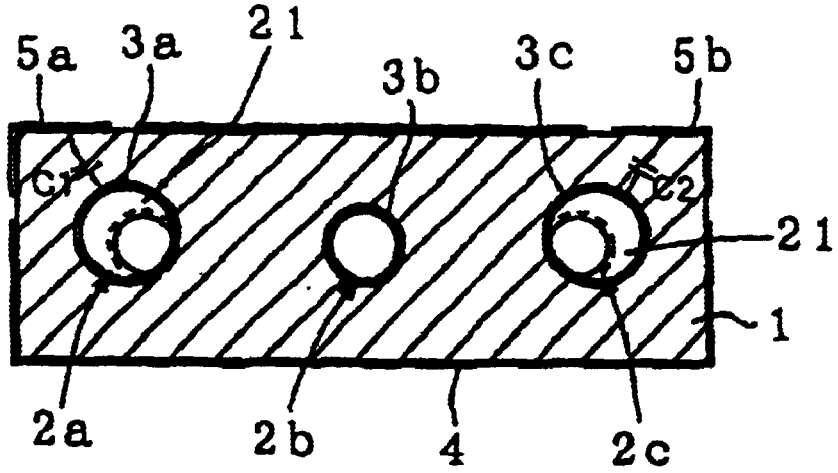
FIG. 4 is a sectional view passing through two input-output electrodes of a second embodiment.

Next, the construction of a dielectric filter according to a second embodiment of the present invention is shown in FIG. 4. The appearance of the dielectric filter is nearly the same as that of the first embodiment shown in FIG. 1, but, as shown in the sectional view of FIG. 4, the inner diameter of the first inner-hole portion of the inner-conductor holes 2*a* and 2*c* opposed to the input-output electrodes 5*a* and 5*b,* respectively, are made larger than the inner diameter of the second inner-hole portion thereof. The first inner-hole portions of the inner-conductor holes 2*a* and 2*c* are arranged so as to be close to the input-output electrodes 5*a* and 5*b,* respectively. Because of this construction, larger external coupling capacitances can be obtained compared with the case of the first embodiment.

In each of the above embodiments, although the inner-conductor holes having a substantially circular cross-section were shown, the cross-section of the inner-conductor holes is not limited to only a circular shape, and it may be polygonal, such as a square, etc., or an oval shape. The inner-conductor holes may be of mixed shapes. Further, the input-output electrodes may be formed only in a main surface acting as a mounting surface.

Figure 5:
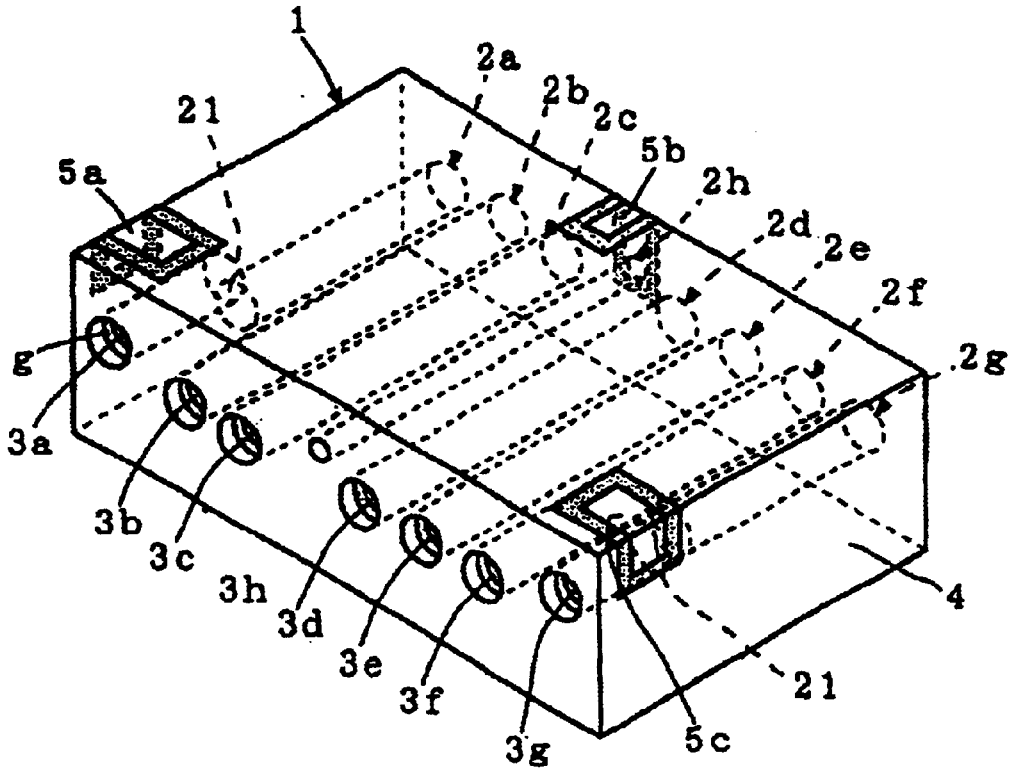
FIG. 5 is a perspective schematic illustration of a dielectric duplexer of a third embodiment.

Next, the construction of a dielectric duplexer according to a third embodiment of the present invention is shown in FIG. 5. In the dielectric duplexer, a transmission side composed of a bandpass filter of a three-stage resonator and a reception side composed of a bandpass filter of a four-stage resonator are formed in a dielectric block 1 in the form of a rectangular solid. Inner-conductor holes 2*a* through 2*c* constituting the resonators on the side of the transmission filter, inner-conductor holes 2*d* through 2*g* constituting the resonators on the side of the reception filter, and an inner-conductor hole 2*h* to obtain an external coupling common to both filters all pass through the dielectric block 1 between a pair of opposing end surfaces. On the inside surface of each of the inner-conductor holes 2*a* through 2*h* acting as resonator holes, inner-conductors 3*a* through 3*h* are formed, respectively. In the vicinity of one opening surface of each of the inner-conductors 3*a* through 3*g,* a portion having no conductor "g" is provided, and this portion is made an open end of each of the resonators. On the outer surface of the dielectric block 1, input-output electrodes 5*a,* 5*b,* and 5*c* are formed, and an external conductor 4 is formed on nearly the whole surface except the areas where the input-output electrodes 5*a* through 5*c* are formed.

The input-output electrode 5*a* acting as a transmission terminal and the input-output electrode 5*c* acting as a reception terminal are formed over one main surface close to the end surface at the open end and over side surfaces of the dielectric block 1, and the input-output electrode 5*b* acting as an antenna terminal common to both filters is formed over the main surface and a short-circuited surface of the dielectric block. The inner-conductor 3*h* of the inner-conductor hole 2*h* is connected to the external conductor on the end surface at the open end and to the input-output electrode 5*b* on the short-circuited surface.

Inside each of the inner-conductor hole 2*a* opposed to the input-output electrode 5*a* and the inner-conductor hole 2*g* opposed to the input-output electrode 5*c,* a stepped portion 21 is formed to define a first inner-conductor portion and a second inner-conductor portion. The first inner-hole portion has the open end and the second inner-hole portion extends to the short-circuited surface. The location of the axis of the first inner-conductor portion and that of the second inner-hole portion are formed so as to be different from each other. Further, each of the axis of the first inner-conductor portions are formed so as to be close to the corresponding input-output electrodes 5*a* and 5*c*.

In the dielectric duplexer, the input-output electrodes 5*a* and 5*c* are capacitance-coupled to the respective inner-conductors 3*a* and 3*g* opposed to the electrodes, and the inner-conductors are externally coupled through the external coupling capacitance. The inner-conductor 3*h* is electromagnetically coupled (meaning interdigital coupling in the present embodiment) to the neighboring inner-conductors 3*c* and 3*d,* and is externally coupled via this coupling.

Also in the dielectric duplexer, as the first inner-hole portion of each of the inner-conductors 3*a* and 3*g* is constructed so as to be close to the input-output electrodes 5*a* and 5*c,* respectively, a large external coupling capacitance can be obtained and the $Q_0$ valve is less reduced.

In the present embodiment, each of the first and second inner-hole portions of the inner-conductor holes is shown to have the same inner diameter over its entire length. However, the holes are not limited to this, and the inner-conductor holes may be constructed to have the first and second inner-hole portions which has different sectional areas.

Further, in the present embodiment, the common input-output portion (input-output electrode 5*b*) is constructed so as to be externally coupled via an electromagnetic coupling, but by providing the common input-output electrode on one main surface, the common input-output electrode may be externally coupled through the capacitance-coupling between the common input-output electrode and the inner-conductor opposed to the electrode. In this case, the inner-conductor holes opposed to the input-output electrodes of the reception-side filter and transmission-side filter are formed as holes having a stepped portion, and the first inner-hole portion of each hole may be formed so as to be close to the input-output electrode.

Moreover, in each of the above embodiments, an open end formed by providing a portion having no inner-conductor at one end portion of each of the inner-conductors was described, however, without forming any external conductor in one opening surface of the inner-conductor holes, the opening surface may be formed as an open surface of each of the resonators. Furthermore, a coupling electrode connected to the inner-conductor may be formed in the open surface.

Further, a comb-like type in which the open end of each of the resonators is arranged at one end surface of the dielectric block was described. However, the invention is not limited thereto, and the open end of each of the resonators may be arranged on any end surface.

Figure 6:
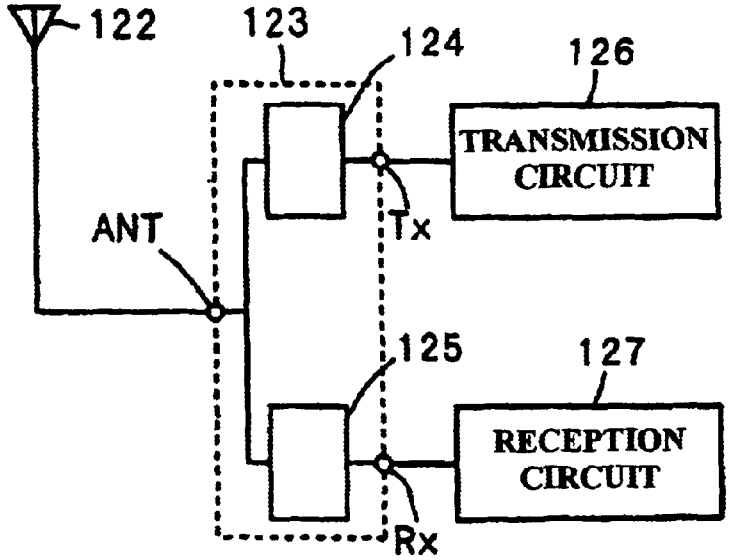
FIG. 6 is a block diagram of a communication apparatus of a fourth embodiment.
Figure 7:
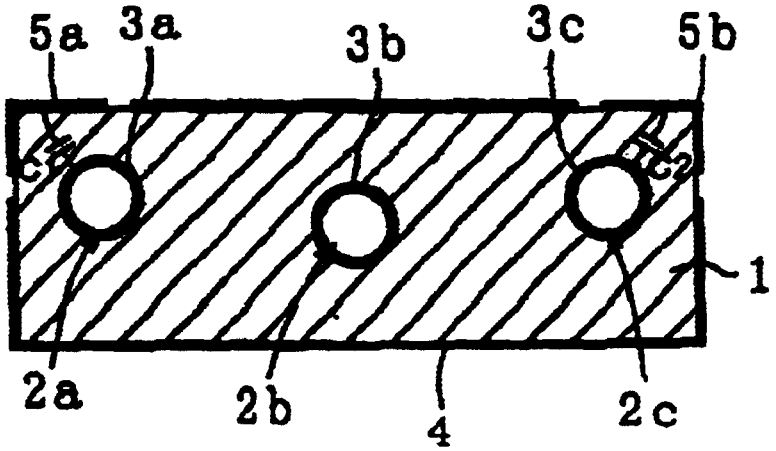
FIG. 7 PRIOR ART
FIG. 7 is a sectional view passing through two input-output electrodes of a conventional dielectric filter.

Next, the construction of a communication apparatus according to a fourth embodiment of the present invention is shown in FIG. 6. In FIG. 6, reference numeral 122 represents an antenna, 123 a duplexer, 124 a transmission filter, 125 a reception filter, 126 a transmission circuit, and 127 a reception circuit. The communication apparatus is constructed by connecting an antenna terminal ANT of the duplexer 124 to the antenna 122, a transmission terminal Tx to the transmission circuit 126, and a reception terminal Rx to the reception circuit 127.

Here, a dielectric filter of the first or second embodiment can be used for the transmission filter 124 or the reception filter 125, and a dielectric duplexer described in the third embodiment can be used for the duplexer. By using a dielectric filter or duplexer according to the present invention a communication apparatus with suitable characteristics can be realized.

As explained above, because a dielectric filter or duplexer according to the present invention is formed so that the open end of the inner-conductor hole opposed to the input-output electrode is close to the input-output electrode, a large external coupling capacitance can be obtained and the $Q_0$ valve is less reduced, and accordingly high a $Q_0$ valve can be realized. Further, by making the diameter at the open end of the inner-conductor hole opposed to the input-output electrode larger than that of the other portion, the external coupling capacitance can be further increased.

Therefore, according to the present invention, a dielectric filter and dielectric duplexer having small insertion loss and suitable characteristics can be obtained.

Further, by mounting a dielectric filter or duplexer according to the present invention a communication apparatus with suitable characteristics can be obtained.

While the invention has been particularly shown and described with reference to preferred embodiments, it will be understood by those skilled in the art that the foregoing and other changes in form and details can be made without departing from the spirit and scope of the invention.

What is claimed is:

1. A dielectric filter comprising:

a dielectric block;

a plurality of inner-conductor holes each having an inner-conductor disposed on an inner surface thereof provided in the dielectric block;

an external conductor disposed on the outer surface of the dielectric block; and input-output electrodes disposed on the outer surface of the dielectric block and capacitance-coupled to respective inner-conductors;

wherein each of the inner-conductors has an open end at at least one opening surface of the corresponding inner-conductor hole or in the vicinity of the opening surface;

each of the inner-conductor holes opposed to the input-output electrodes has a stepped portion to define a first inner-conductor hole portion and a second inner-conductor hole portion divided thereby; and the first inner-conductor hole portion has the open end and is located closer to the input-output electrode than the second inner-conductor hole portion;

the respective first inner-conductor hole portions of the inner-conductor holes opposed to the input-output electrodes having first corresponding longitudinal axes which define a first longitudinal plane, each of said first corresponding longitudinal axes being parallel to said first longitudinal plane;

the respective second inner-conductor hole portions of the inner-conductor holes opposed to the input-output electrodes having second corresponding longitudinal axes which define a second longitudinal plane, each of said second corresponding longitudinal axes being parallel to said second longitudinal plane;

said first and second planes being spaced apart along a thickness direction of the dielectric block so that said axes of said first and second inner-conductor hole portions are in different respective longitudinal planes.

2. The dielectric filter according to claim 1, wherein the sectional area of the first inner-conductor hole portion is larger than that of the second inner-conductor hole portion.

3. A dielectric duplexer comprising at least two filter portions formed in dielectric block, wherein at least one of the filter portions is composed of the dielectric filter of one of claims 1 and 2.

4. A communication apparatus comprising the dielectric duplex of claim 3; and further comprising a transmission circuit and a reception circuit; the transmission circuit being connected to one of the two filter portions in the dielectric duplexer, the reception circuit being connected to the other of the two filter portions.

5. A communication apparatus comprising a dielectric filter according to one of claims 1 and 2, and further comprising at least one of a transmission circuit and a reception circuit connected to said dielectric filter.

* * * * *